US008604399B2

(12) United States Patent
Smith et al.

(10) Patent No.: US 8,604,399 B2
(45) Date of Patent: Dec. 10, 2013

(54) MICROWAVABLE BAGS FOR USE WITH LIQUID OIL AND RELATED METHODS

(75) Inventors: Allyson Smith, Columbia, SC (US); Stuart Sharp, Greer, SC (US)

(73) Assignee: Exopack, LLC, Spartanburg, SC (US)

( * ) Notice: Subject to any disclaimer, the term of this patent is extended or adjusted under 35 U.S.C. 154(b) by 576 days.

(21) Appl. No.: 12/581,279

(22) Filed: Oct. 19, 2009

(65) Prior Publication Data

US 2011/0089168 A1 Apr. 21, 2011

(51) Int. Cl.
*H05B 6/80* (2006.01)
*H05B 6/64* (2006.01)

(52) U.S. Cl.
USPC ..... 219/725; 219/726; 219/727; 219/728; 219/729; 219/730; 219/756; 219/759

(58) Field of Classification Search
USPC ..... 219/725–730, 756, 759
See application file for complete search history.

(56) References Cited

U.S. PATENT DOCUMENTS

| | | | |
|---|---|---|---|
| 2,870,954 | A | 1/1959 | Kulesza |
| 2,997,224 | A | 8/1961 | Stannard |
| 3,567,111 | A | 3/1971 | Baxter |
| 3,570,748 | A | 3/1971 | Coyle et al. |
| 3,628,720 | A | 12/1971 | Schmedding |
| 3,687,356 | A | 8/1972 | Goodrich et al. |
| 3,784,085 | A | 1/1974 | Kilgore |
| 3,900,670 | A | 8/1975 | Ikeda et al. |
| 3,910,488 | A | 10/1975 | Goodrich |
| 3,924,013 | A | 12/1975 | Kane |
| 3,927,825 | A | 12/1975 | Stearley |
| 3,939,025 | A | 2/1976 | Kane |
| 3,966,115 | A | 6/1976 | Hollis |
| 3,967,998 | A | 7/1976 | Kane |
| 4,008,850 | A | 2/1977 | Goodrich |
| 4,088,264 | A | 5/1978 | Vogt |
| 4,096,309 | A | 6/1978 | Stillman |
| 4,147,291 | A | 4/1979 | Akao et al. |
| 4,387,126 | A | 6/1983 | Rebholz |
| 4,493,127 | A | 1/1985 | Blanke, Jr. et al. |
| 4,515,273 | A | 5/1985 | Jacobson et al. |
| 4,521,910 | A | 6/1985 | Keppel et al. |
| 4,705,707 | A | 11/1987 | Winter |
| 4,716,061 | A | 12/1987 | Winter |
| 4,743,123 | A | 5/1988 | Legters et al. |
| 4,753,832 | A | 6/1988 | Brown et al. |
| 4,797,010 | A | 1/1989 | Coelho |
| 4,806,398 | A | 2/1989 | Martin |

(Continued)

FOREIGN PATENT DOCUMENTS

| | | |
|---|---|---|
| DE | 0148436 | 5/1981 |
| EP | 0822063 | 4/1998 |

(Continued)

OTHER PUBLICATIONS

Notice of Publication dated Dec. 31, 2009 for U.S. Appl. No. 12/556,151.

(Continued)

*Primary Examiner* — Ngan Ngo
(74) *Attorney, Agent, or Firm* — Stoel Rives LLP

(57) ABSTRACT

Microwavable bags can include one or more seals formed by a cold seal adhesive. The one or more seals can prevent egress of liquid oil from the bag.

22 Claims, 5 Drawing Sheets

(56) References Cited

U.S. PATENT DOCUMENTS

| | | | | |
|---|---|---|---|---|
| 4,808,421 | A | 2/1989 | Mendenhall et al. | |
| 4,894,264 | A | 1/1990 | Akao et al. | |
| 4,904,093 | A | 2/1990 | Woods et al. | |
| 4,930,906 | A | 6/1990 | Hemphill | |
| 4,946,289 | A | 8/1990 | Bolling et al. | |
| 4,949,529 | A | 8/1990 | Davis | |
| 4,952,441 | A | 8/1990 | Bose et al. | |
| 4,971,454 | A | 11/1990 | Branson et al. | |
| 4,994,324 | A | 2/1991 | Bose et al. | |
| 5,007,233 | A | 4/1991 | Bose | |
| 5,038,009 | A | 8/1991 | Babbitt | |
| 5,051,284 | A | 9/1991 | Johansson et al. | |
| 5,073,421 | A | 12/1991 | Akao | |
| 5,091,228 | A | 2/1992 | Fujii et al. | |
| 5,097,956 | A | 3/1992 | Davis | |
| 5,171,594 | A | 12/1992 | Babbitt | |
| 5,225,256 | A | 7/1993 | Marano et al. | |
| 5,244,702 | A | 9/1993 | Finestone et al. | |
| 5,273,361 | A | 12/1993 | Jillson | |
| 5,281,027 | A | 1/1994 | Thrall | |
| 5,302,427 | A | 4/1994 | Murschall et al. | |
| 5,310,587 | A | 5/1994 | Akahori et al. | |
| 5,330,845 | A | 7/1994 | Andersson et al. | |
| 5,332,586 | A | 7/1994 | Di Mino | |
| 5,342,662 | A | 8/1994 | Aoyama et al. | |
| 5,345,399 | A | 9/1994 | Collins | |
| 5,376,392 | A | 12/1994 | Ikegami et al. | |
| 5,399,022 | A | 3/1995 | Sheets | |
| 5,405,663 | A | 4/1995 | Archibald et al. | |
| 5,415,910 | A | 5/1995 | Knauf | |
| 5,470,594 | A | 11/1995 | Di Mino | |
| 5,482,376 | A | 1/1996 | Moseley et al. | |
| 5,488,220 | A | 1/1996 | Freerks et al. | |
| 5,512,338 | A | 4/1996 | Bianchini et al. | |
| 5,520,464 | A | 5/1996 | Kristola | |
| 5,520,970 | A | 5/1996 | Christensson et al. | |
| 5,529,396 | A | 6/1996 | Pryor et al. | |
| 5,536,542 | A | 7/1996 | Gillespie et al. | |
| 5,553,942 | A | 9/1996 | Domke et al. | |
| 5,558,438 | A | 9/1996 | Warr | |
| 5,560,296 | A | 10/1996 | Adams | |
| 5,560,945 | A | 10/1996 | Geddes et al. | |
| 5,593,229 | A | 1/1997 | Warr | |
| 5,601,369 | A | 2/1997 | Moseley et al. | |
| 5,604,042 | A | 2/1997 | Bianchini et al. | |
| 5,611,626 | A | 3/1997 | Warr | |
| 5,659,933 | A | 8/1997 | McWilliams | |
| 5,728,037 | A | 3/1998 | Pryor et al. | |
| 5,770,839 | A | 6/1998 | Ruebush et al. | |
| 5,814,382 | A | 9/1998 | Yannuzzi, Jr. | |
| 5,851,608 | A | 12/1998 | Yamada et al. | |
| 5,871,790 | A | 2/1999 | Monier et al. | |
| 5,876,815 | A | 3/1999 | Sandstrom et al. | |
| RE36,177 | E | 4/1999 | Rouyer et al. | |
| 5,902,046 | A | 5/1999 | Shibata | |
| 5,912,070 | A | 6/1999 | Miharu et al. | |
| 6,003,670 | A | 12/1999 | Beer | |
| 6,019,713 | A | 2/2000 | Scypinski et al. | |
| 6,046,443 | A | 4/2000 | Ackerman et al. | |
| 6,060,095 | A * | 5/2000 | Scrimager | 426/107 |
| 6,065,871 | A | 5/2000 | Warr | |
| 6,071,576 | A | 6/2000 | Bentmar et al. | |
| 6,137,098 | A | 10/2000 | Moseley et al. | |
| 6,187,396 | B1 | 2/2001 | Möller | |
| 6,213,644 | B1 | 4/2001 | Henderson et al. | |
| 6,231,232 | B1 | 5/2001 | Warr | |
| 6,248,442 | B1 | 6/2001 | Kong et al. | |
| 6,299,351 | B1 | 10/2001 | Warr | |
| 6,333,086 | B1 | 12/2001 | Ora et al. | |
| 6,346,332 | B1 | 2/2002 | Bryden et al. | |
| 6,367,976 | B1 | 4/2002 | Bannister | |
| 6,372,317 | B1 | 4/2002 | Denney et al. | |
| 6,374,461 | B1 | 4/2002 | Gober et al. | |
| 6,375,981 | B1 | 4/2002 | Gilleland et al. | |
| 6,402,379 | B1 | 6/2002 | Albright | |
| 6,436,547 | B1 | 8/2002 | Toft et al. | |
| 6,479,137 | B1 | 11/2002 | Joyner | |
| 6,500,505 | B2 | 12/2002 | Piper et al. | |
| 6,509,105 | B2 | 1/2003 | Olvey | |
| 6,528,088 | B1 | 3/2003 | Gilleland et al. | |
| 6,534,137 | B1 | 3/2003 | Vadhar | |
| 6,565,936 | B1 | 5/2003 | Peiffer et al. | |
| 6,576,304 | B2 | 6/2003 | Yamada et al. | |
| 6,579,580 | B1 | 6/2003 | Yamada et al. | |
| 6,589,384 | B2 | 7/2003 | Chen et al. | |
| 6,609,999 | B2 | 8/2003 | Albright | |
| 6,623,162 | B2 | 9/2003 | Pang | |
| 6,652,984 | B2 | 11/2003 | Finestone et al. | |
| 6,673,465 | B2 | 1/2004 | Lordi | |
| 6,715,919 | B2 | 4/2004 | Hiraiwa et al. | |
| 6,746,736 | B2 | 6/2004 | Leeper et al. | |
| 6,767,600 | B1 | 7/2004 | Kasahara | |
| 6,797,395 | B2 | 9/2004 | Finestone et al. | |
| 6,855,387 | B2 | 2/2005 | Yamada et al. | |
| 6,858,313 | B2 | 2/2005 | Musco et al. | |
| 6,883,964 | B2 | 4/2005 | Beaulieu | |
| 6,887,538 | B2 | 5/2005 | Denney et al. | |
| 6,893,686 | B2 | 5/2005 | Egan | |
| 6,919,111 | B2 | 7/2005 | Swoboda et al. | |
| 6,921,563 | B2 | 7/2005 | Goerlitz et al. | |
| 6,926,951 | B2 | 8/2005 | Huffer et al. | |
| 6,926,968 | B2 | 8/2005 | Lordi | |
| 6,964,797 | B2 | 11/2005 | Salste et al. | |
| 6,974,612 | B1 | 12/2005 | Frisk et al. | |
| 7,090,904 | B2 | 8/2006 | Hartzell et al. | |
| 7,147,913 | B2 | 12/2006 | Iwasaki et al. | |
| 7,157,126 | B2 | 1/2007 | Cosentino et al. | |
| 7,459,214 | B2 | 12/2008 | Olofsson et al. | |
| 7,476,441 | B2 | 1/2009 | Iwasaki et al. | |
| 2003/0229168 | A1 | 12/2003 | Borsinger et al. | |
| 2004/0038792 | A1 | 2/2004 | Albright | |
| 2004/0052987 | A1 | 3/2004 | Shetty et al. | |
| 2004/0091648 | A1 | 5/2004 | Hartzell et al. | |
| 2004/0105600 | A1 | 6/2004 | Floyd, Jr. | |
| 2004/0105942 | A1 | 6/2004 | Cable | |
| 2004/0136616 | A1 | 7/2004 | Allen et al. | |
| 2004/0137206 | A1 | 7/2004 | Pettis | |
| 2004/0175060 | A1 | 9/2004 | Woodham et al. | |
| 2004/0191438 | A1 | 9/2004 | Cosentino et al. | |
| 2004/0217112 | A1 | 11/2004 | Monforton et al. | |
| 2004/0228547 | A1 | 11/2004 | Hartzell et al. | |
| 2005/0008736 | A1 | 1/2005 | Egan et al. | |
| 2005/0084185 | A1 | 4/2005 | Moon | |
| 2005/0100252 | A1 | 5/2005 | Rivlin et al. | |
| 2005/0112305 | A1 | 5/2005 | Swoboda et al. | |
| 2005/0191399 | A1 | 9/2005 | Jackson et al. | |
| 2005/0230384 | A1 | 10/2005 | Robinson et al. | |
| 2006/0073292 | A1 | 4/2006 | Hartzell et al. | |
| 2007/0042146 | A1 | 2/2007 | Sharp | |
| 2007/0047852 | A1 | 3/2007 | Sharp et al. | |
| 2007/0047853 | A1 | 3/2007 | Sharp et al. | |
| 2008/0070047 | A1 | 3/2008 | Rehkugler et al. | |
| 2008/0078759 | A1 | 4/2008 | Wnek et al. | |
| 2008/0166457 | A1 | 7/2008 | Gorman et al. | |
| 2008/0268106 | A1 | 10/2008 | Jackson et al. | |
| 2009/0045189 | A1 * | 2/2009 | Cormier et al. | 219/727 |
| 2012/0085754 | A1 * | 4/2012 | Mir | 219/725 |

FOREIGN PATENT DOCUMENTS

| | | |
|---|---|---|
| FR | 2256660 | 7/1975 |
| FR | 2847232 | 11/2002 |
| GB | 1462941 | 1/1977 |
| GB | 2351039 | 12/2000 |
| NL | 6806715 | 7/1968 |
| WO | WO 00/53429 | 9/2000 |
| WO | WO 01/94451 | 12/2001 |
| WO | WO 03064167 | 8/2003 |
| WO | WO-2008/045467 | 4/2008 |

OTHER PUBLICATIONS

Office Action dated Jan. 5, 2010 for U.S. Appl. No. 11/240,944.
Office Action dated Jan. 5, 2010 for U.S. Appl. No. 11/214,419.

(56) References Cited

OTHER PUBLICATIONS

Office Action dated Jan. 5, 2010 for U.S. Appl. No. 11/214,434.
Graphic Packaging International, Graphic Packaging Expands Microrite® Line with New Oil-Absorbent Sleeve for Beckers in Europe (Nov. 30, 2005), available at http://phx.corporate-ir.net/phoenix.zhtml?c=103159&p=irol-newsArticle&ID=791279&highlight=.
"While Bags Take a Beating from China, Bemis Offers a New Poly/Plastic Hybrid Solution," Packaging Strategies, vol. 26, No. 16, p. 4 (Sep. 15, 2008).
"Mulilayer Kraft Paper Bag for Food Products," DD-148-436, 1 page (May 1981). (DL-1981-05).
Notification of Transmittal of the International Search Report and the Written Opinion of the International Searching Authority issued Mar. 18, 2008 in International Application No. PCT/US06/031690.
Requirement for Restriction/Election dated Apr. 21, 2008 in co-pending U.S. Appl. No. 11/240,944.
Response to the Restriction/Election dated May 21, 2008 in co-pending U.S. Appl. No. 11/240,944.
Office Action dated Jul. 24, 2008 in co-pending U.S. Appl. No. 11/240,944.
Response to the Office Action dated Nov. 24, 2008 in co-pending U.S. Appl. No. 11/240,944.
Terminal Disclaimers and 3,73(b) Statement dated Nov. 24, 2008 in co-pending U.S. Appl. No. 11/240,944.
Office Action dated Feb. 6, 2009 in co-pending U.S. Appl. No. 11/240,944.
Examiner Interview Summary dated Mar. 12, 2009 in co-pending U.S. Appl. No. 11/240,944.
Request for Continued Examination submitted with a Response to the Office Action and a Rule 131 Declaration dated May 6, 2009 in co-pending U.S. Appl. No. 11/240,944.
Office Action dated Jul. 21, 2009 in co-pending U.S. Appl. No. 11/240,944.
Draft Claims for an In-Person Interview dated Oct. 5, 2009 in co-pending U.S. Appl. No. 11/240,944.
Response to the Office Action with an Appendix dated Oct. 21, 2009 in co-pending U.S. Appl. No. 11/240,944.
Examiner Interview Summary dated Oct. 22, 2009 in co-pending U.S. Appl. No. 11/240,944.
Requirement for Restriction/Election dated May 12, 2008 in co-pending U.S. Appl. No. 11/214,419.
Response to the Requirement for Restriction/Election dated Jun. 12, 2008 in co-pending U.S. Appl. No. 11/214,419.
Office Action dated Jul. 21, 2008 in co-pending U.S. Appl. No. 11/214,419.
Response to the Office Action dated Nov. 21, 2008 in co-pending U.S. Appl. No. 11/214,419.
Terminal Disclaimers and 3.73(b) Statement dated Nov. 21, 2008 in co-pending U.S. Appl. No. 11/214,419.
Office Action dated Feb. 10, 2009 in co-pending U.S. Appl. No. 11/214,419.
Examiner Interview Summary dated Mar. 12, 2009 in co-pending U.S. Appl. No. 11/214,419.
Request for Continued Examination submitted with a Response to the Office Action and a Rule 131 Declaration dated May 7, 2009 in co-pending U.S. Appl. No. 11/214,419.
Office Action dated Jul. 21, 2009 in co-pending U.S. Appl. No. 11/214,419.
Draft Claims for an In-Person Interview dated Oct. 5, 2009 in co-pending U.S. Appl. No. 11/214,419.
Response to the Office Action with an Appendix dated Oct. 21, 2009 in co-pending U.S. Appl. No. 11/214,419.
Examiner Interview Summary dated Oct. 21, 2009 in co-pending U.S. Appl. No. 11/214,419.
Office Action dated Jul. 22, 2008 in co-pending U.S. Appl. No. 11/214,434.
Response to the Office Action dated Nov. 24, 2008 in co-pending U.S. Appl. No. 11/214,434.
Terminal Disclaimers and 3.73(b) Statement dated Nov. 24, 2008 in co-pending U.S. Appl. No. 11/214,434.
Office Action dated Feb. 5, 2009 in co-pending U.S. Appl. No. 11/214,434.
Request for Continued Examination submitted with a Response to the Office Action and a Rule 131 Declaration dated May 4, 2009 in co-pending U.S. Appl. No. 11/214,434.
Office Action dated Jul. 23, 2009 in co-pending U.S. Appl. No. 11/214,434.
Draft Claims for an In-Person Interview dated Oct. 5, 2009 in co-pending U.S. Appl. No. 11/214,434.
Response to the Office Action with an Appendix dated Oct. 21, 2009 in co-pending U.S. Appl. No. 11/214,434.
Examiner Interview Summary dated Oct. 21, 2009 in co-pending U.S. Appl. No. 11/214,434.
Co-pending U.S. Appl. No. 12/341,080, titled Multi-Layer Bags and Methods of Manufacturing the Same, filed Dec. 22, 2008.
Co-pending U.S. Appl. No. 12/335,414, titled Multi-Layer Bags and Methods of Manufacturing the Same, filed Dec. 15, 2008.
European Search Report dated Oct. 23, 2009.
Bentley, David J., Jr., "About Cold Seal Adhesives", Paper Film and Foil Converter, 2 pgs., Jan. 2006.
Smith, Nancy, "Cold Seal Adhesives", Rhom & Haas company, Aimcal Conference, 6 pgs., 2005.

* cited by examiner

MICROWAVABLE BAGS FOR USE WITH LIQUID OIL AND RELATED METHODS

TECHNICAL FIELD

The present disclosure relates to microwavable bags.

SUMMARY

Embodiments of microwavable bags for use with liquid oil, as well as methods for manufacturing the same, are disclosed. Particular features of various embodiments are disclosed herein and are recited in the appended claims, which are hereby incorporated by reference into this summary section.

The drawings are not necessarily to scale and thus, in some instances, layer thicknesses or other sizes may be exaggerated or otherwise altered.

DETAILED DESCRIPTION

Certain bags configured for use in heating food in a microwave oven can be particularly well-suited for popping popcorn. Microwavable popcorn bags are often formed from laminates that comprise two paper plies, and the laminates may be treated with a chemical barrier or a film former to provide the bags with grease resistance. The bags generally store a mixture of unpopped popcorn kernels and fats. The fats are solid at room temperature, as well as at elevated temperatures experienced during packaging and/or transport of the bags, and often include trans fats and/or hydrogenated oils. The bags are generally sealed via heat seals. Although the heat seals may adequately prevent solid fats from exiting the bags, the seals are not capable of preventing the escape of liquid oils.

Certain embodiments of microwavable bags disclosed herein are advantageously configured to retain liquid oils, such as, for example, oils that are free or substantially free of trans fat and/or oils that are in a liquid state at room temperature. In some embodiments, the microwavable bags include a body material that comprises one or more paper plies. The microwavable bags can have a pinch bottom closure in which portions of one or more gussets are sealed between a front wall and a rear wall of the bag. The pinch bottom closure can be sealed via a cold seal adhesive, which can prevent liquid oil from exiting the bag via the closure.

Figure 1:
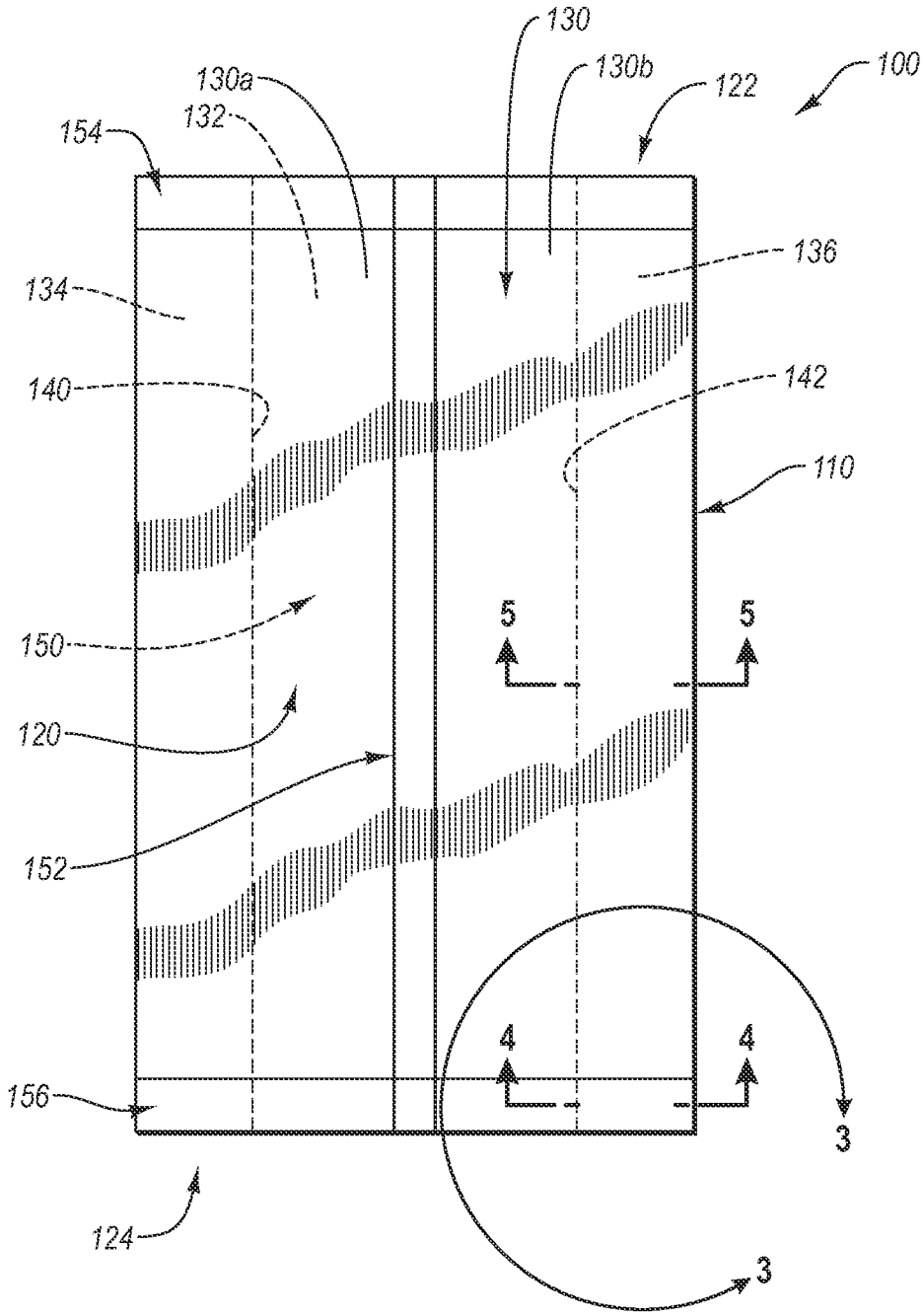
FIG. 1 is a plan view of an embodiment of a microwavable bag suitable for use with liquid oil.

With reference to FIG. 1, in certain embodiments, a microwavable bag 100 comprises a body material 110. The body material 110 can be grease resistant such that liquid oil contained within the bag 100 is substantially prevented from exiting the bag 100 through the body material 110. For example, in various embodiments, the body material 110 can include a paper layer or laminated structure that has received a standard fluorocarbon treatment in a manner known in the art, or has received a non-telomere fluorocarbon treatment (e.g., via chemicals available from Solvay SA of Brussels, Belgium). In other embodiments, the body material 110 can comprise a highly refined paper, similar to glassine, which imparts grease-resistance without fluorocarbon treatment. In other or further embodiments, the body material 110 can comprise a grease-resistant coating. In certain embodiments, the body material 110 can comply with stringent government regulations that may exist with respect to microwavable packaging, which in some cases may restrict the use of certain polymer-based substrates.

Figure 4:
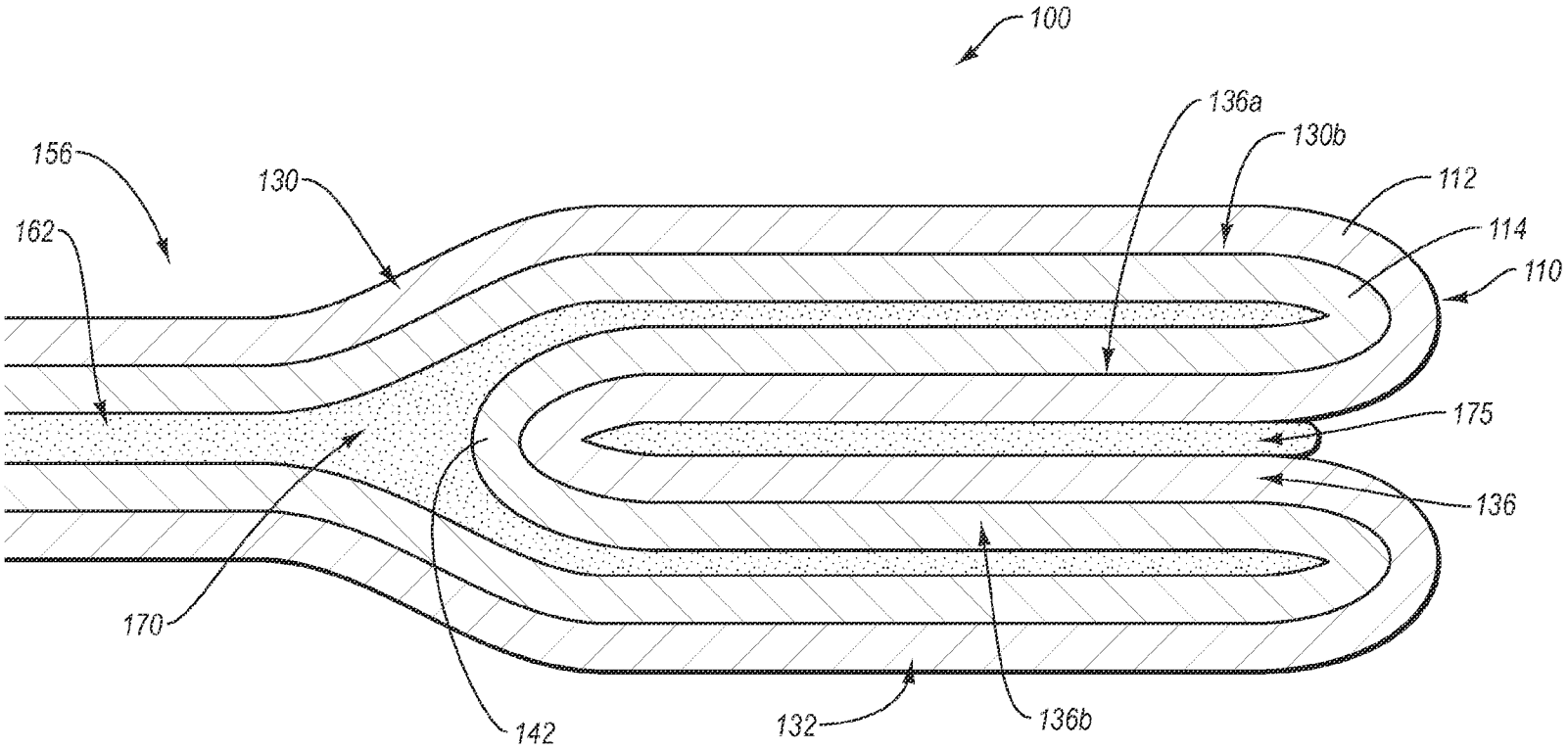
FIG. 4 is a cross-sectional view of a portion of the microwavable bag of FIG. 1 taken along the view line 4-4 in FIG. 1.
Figure 5:
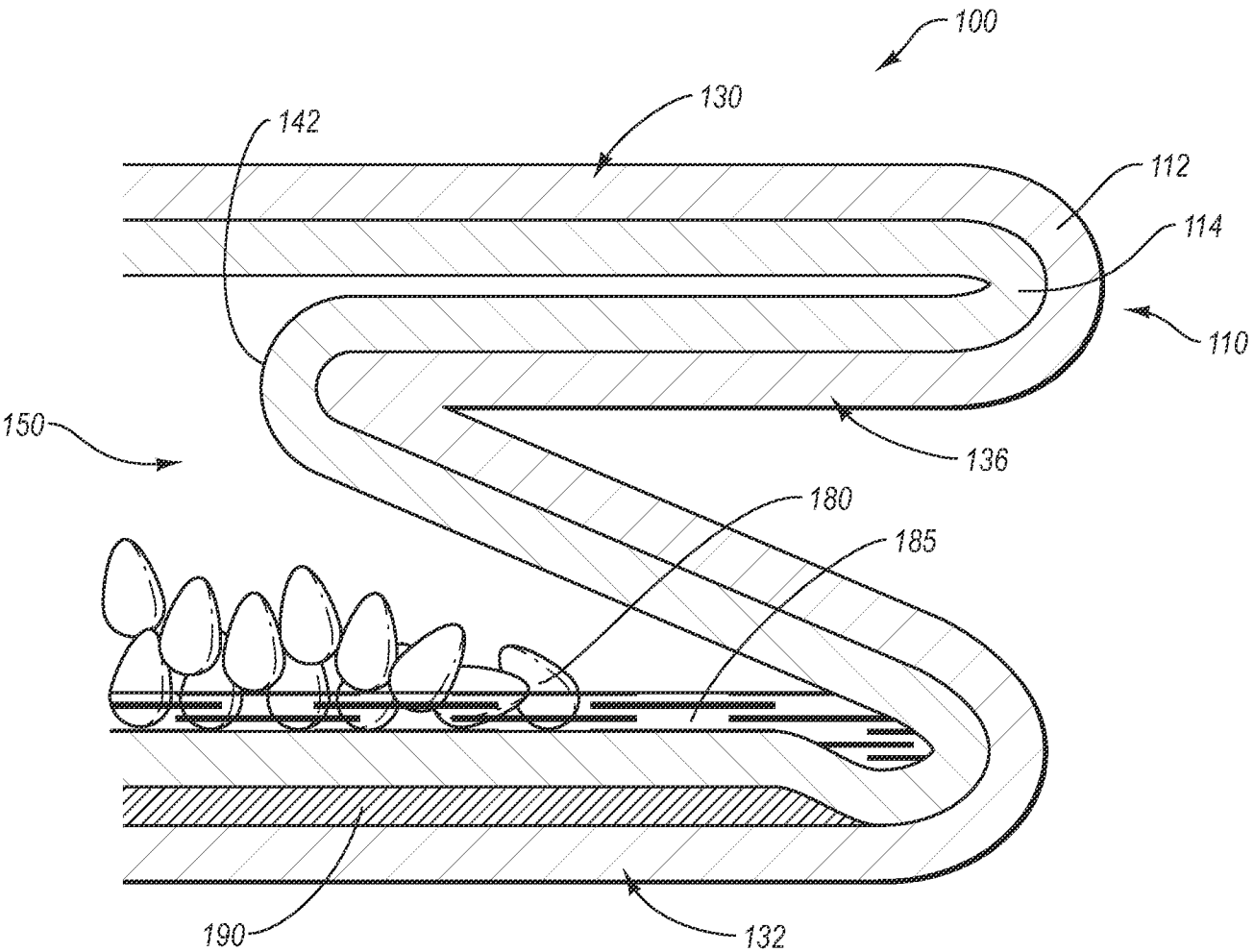
FIG. 5 is a cross-sectional view of another portion of the microwavable bag of FIG. 1 taken along the view line 5-5 in FIG. 1.

In the illustrated embodiment, as shown in FIGS. 4 and 5, the body material 110 comprises a laminate having an outer paper ply 112 and an inner paper ply 114. One or more of the outer and inner paper plies 112, 114 can be treated with a chemical barrier, a film former, and/or any other suitable treatment to prevent liquid oil from passing through the plies.

In other embodiments, the body material 110 can comprise other structures and compositions. For example, more or fewer paper plies and/or layers of other materials may be included in the laminate. Examples of suitable body materials 110 and coatings are disclosed in U.S. patent application Ser. No. 10/843,760, which was filed on May 12, 2004 and published as U.S. Patent Application Publication No. 2005/008736 on Jan. 13, 2005. The portions of the foregoing application that relate to the structure and composition of body materials are hereby incorporated by reference herein as non-limiting examples.

With reference again to FIG. 1, in certain embodiments, the body material 110 can define a tube 120 having an upper end 122 and a lower end 124. The tube 120 can include a front wall 130, a back wall 132, a left side wall 134, and a right side wall 136 that cooperate to define an interior cavity 150 of the tube 120 (see also FIG. 5). As used herein, terms describing orientation, such as front, back, left, right, etc., are recited from the perspective illustrated in FIG. 1. Such directional terms are used for convenience and should not be construed as limiting, unless so specified in the claims.

The front wall 130 can comprise a left panel 130*a* and a right panel 130*b* that are joined to each other via a seam 152. In the illustrated embodiment, the seam 152 extends longitudinally from the upper end 122 to the lower end 124 of the tube 120. The seam 152 can comprise any suitable seal, such as, for example, a lap seal or a fin seal, and can be configured to prevent liquid oil from passing through the seal.

As further discussed below, the tube 120 can comprise a seal or a seam 154 at the upper end 122 and a seal or seam 156 at the lower end 124. Each seam 154, 156 can be configured to prevent liquid oil from passing through it. For example, a food product, such as unpopped popcorn kernels and oil or fats having a relatively low melting point, can be received within the interior cavity 150 of the tube 120 and sealed therein via the seams 154, 156, and each seam 154, 156 can prevent the liquid oil from exiting the interior cavity 150 via the upper and lower ends 122, 124 of the tube 120, respectively.

Figure 2:
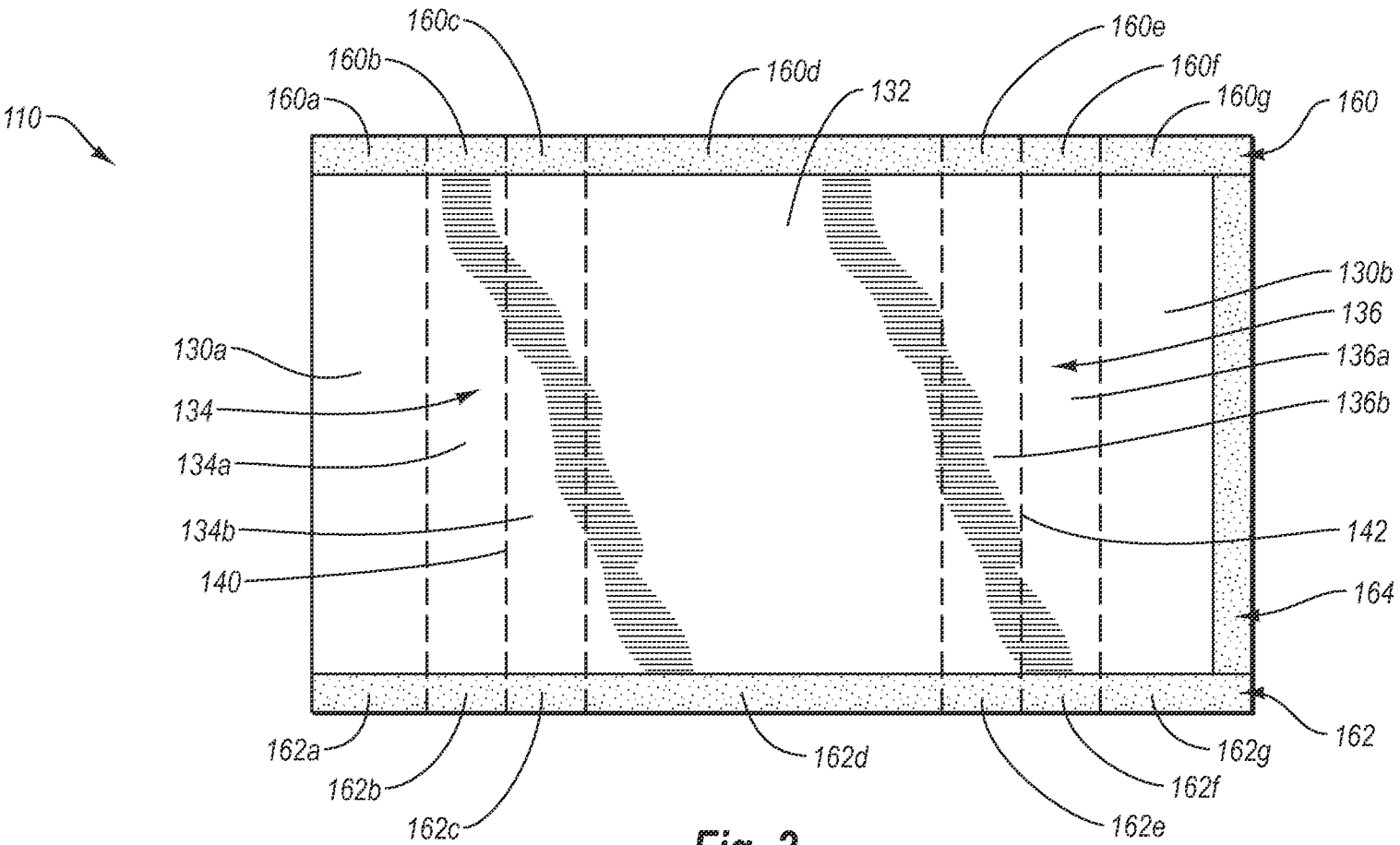
FIG. 2 is a plan view of an embodiment of body material prepared for formation into an embodiment of a microwavable bag such as that of FIG. 1.

FIG. 2 illustrates an embodiment of the body material 110 prior to being formed into a bag 100. The left and right panels 130*a*, 130*b* of the front wall 130, the left and right side walls 134, 136, and the back wall 132 are shown. In the illustrated embodiment, the left side wall 134 includes a front panel 134*a* and a back panel 134*b* and the right side wall 136 includes a front panel 136*a* and a back panel 136*a*. The left and right side walls 134, 136 can be folded such that the front and back panels 134*a*, 134*b*, 136*a*, 136*b*, respectively, form side gussets of the bag 100. For example, the left and right side walls 134, 136 can be folded along creases 140, 142. At least a portion of each of the creases 140, 142 can be positioned between the front and back walls 130, 132 when the bag 100 is in an assembled state, as shown in FIGS. 1, 4, and 5.

With continued reference to FIG. 2, a cold seal adhesive 160 can be disposed along or near a top edge of the body material 110, and can extend substantially continuously between an edge of the left panel 130*a* and an edge of the right panel 130*b*. In the illustrated embodiment, separate sections of the cold seal adhesive 160 cover the top edges of the walls and panels. Specifically, sections 160*a*, 160*b*, 160*c*, 160*d*, 160*e*, 160*f*, and 160*g* of the cold seal adhesive 160 cover the top edges of the left panel 130*a*, the front panel 134*a*, the back panel 134*b*, the back wall 132, the back panel 136*b*, the front panel 136*a*, and the right panel 130*b*, respectively.

The cold seal adhesive 160 can be applied to the body material 110 in any suitable fashion. For example, in some embodiments, a flexographic technique may be used in which the cold seal adhesive 160 is applied to the body material 110 via photopolymer plates. The cold seal adhesive 160 can be transferred to the body material 110 in a wet state and allowed to dry. In other embodiments, a rotogravure style press may be used to apply the cold seal adhesive 160 to the body material 110.

A cold seal adhesive 162 can be disposed at or near a bottom edge of the body material 110, and can extend substantially continuously between an edge of the left panel 130*a* and an edge of the right panel 130*b*. In the illustrated embodiment, sections 162*a*, 162*b*, 162*c*, 162*d*, 162*e*, 162*f*, and 162*g* of the cold seal adhesive 162 cover the bottom edges of the left panel 130*a*, the front panel 134*a*, the back panel 134*b*, the back wall 132, the back panel 136*b*, the front panel 136*a*, and the right panel 130*b*, respectively. The cold seal adhesive 162 can be applied to the body material 110 in any of the manners described above with respect to the adhesive 160.

In some embodiments, the amount of cold seal adhesive 160, 162 applied to the body material 110 can be greater than the amount of heat seal adhesive used for bags of comparable capacity. For example, for some bags, a heat seal adhesive for closing both ends of a bag is used in an amount of from about 3 pounds to about 3.5 pounds per ream, when dry, or from about 6 pounds to about 7 pounds per ream when wet. In contrast, in various embodiments of bags configured to retain liquid oil, the amount of cold seal adhesive 162 applied to the body material 110 for sealing both ends of a bag 100 can be in a range of from about 8 pounds to about 12 pounds or can be no less than about 8 pounds, no less than about 9 pounds, no less than about 10 pounds, no less than 11 pounds, or no less than about 12 pounds per ream when the cold seal adhesive 162 is dry. The amount of cold seal adhesive 162 can be in a range of from about 16 pounds to about 24 pounds or can be no less than about 16 pounds, no less than about 18 pounds, no less than about 20 pounds, no less than about 22 pounds, or no less than about 24 pounds per ream when wet.

Cold seal adhesives are generally configured to form a seal when separate portions of the adhesive are brought into contact with each other and pressure is applied. Unlike heat seal adhesives, cold seal adhesives can create the seal without the additional application of heat. However, as discussed below, it can be desirable to heat the cold seal adhesive when forming a seal in some instances. A variety of existing cold seal adhesives can be used or readily modified for use with embodiments of the bag 100. For example, cold seal adhesives produced by Ashland Inc. of Covington, Ky.; H.B. Fuller Co. of Vadnais Heights, Minnesota; Henkel Corporation of Rocky Hill, Conn.; and Rohm and Haas Company of Philadelphia, Pa. may be used or modified.

Cold seal adhesives can include an adhesive component combined with an elastomer. The adhesive component can comprise, for example, one or more of vinyl acetate polymers and copolymers and acrylic polymers. The elastomer can comprise one or more of natural rubber latex and synthetic elastomers, such as, for example, styrene butadiene rubber, polycholroprene, and butyl rubber.

Cold seal adhesives can have "hard" or "soft" characteristics. Hard cold seal adhesives are generally less tacky and can require greater pressure to create a seal, as compared with soft cold seal adhesives. In some embodiments, a balance between the features of hard and soft varieties of cold seal adhesives can be desirable. For example, in some instances, the cold seal adhesives 160, 162 are applied and the lower seam 156 is sealed at a first manufacturing facility. However, the upper seam 154 may be sealed at a second facility after a food product has been introduced into the semi-formed bag 100. In such instances, it may be desirable for the cold seal adhesive 160 to be relatively hard to prevent premature formation of the upper seam 154 during transport of the semi-formed bag 100 from the first facility to the second facility. In other instances, it can be desirable for the cold seal adhesive 160 to be relatively soft. This may allow for simpler application of the cold seal adhesive 160 to the bag material 110 (which may result from better deformation properties of soft adhesives) and/or quicker or easier formation of the seal (which may result from the tackier properties of soft adhesives). In some embodiments, it can be desirable for one or both of the cold seal adhesives 160, 162 to have hard characteristics at relatively low temperatures (e.g., room temperature) and to behave in a softer manner at elevated temperatures (e.g., about 100 degrees Fahrenheit to about 250 degrees Fahrenheit) such that the adhesives 160, 162 can be resistant to prematurely forming a seal 154, 156 during storage, transport, and/or early stages of conversion, but may readily form the seal 154, 156 upon application of heat and pressure at a desired stage of a conversion process or other bag sealing process.

In some embodiments, one or both of the cold seal adhesives 160, 162 are relatively resistant to blocking. A variety of tests are available to determine the blocking resistance of a cold seal adhesive 160, 162. For example, in some embodiments, the ASTM D918 Standard Test for Blocking Resistance of Paper and Paperboard, as this test is understood by those skilled in the art, may be used to characterize the blocking resistance. In further embodiments, it can be possible to use a test similar to ASTM D918, but with altered testing conditions (e.g., altered environmental temperatures and humidity, increased pressures applied to the samples, shorter dwell times, etc.) to more closely simulate actual conditions to which the cold seal adhesives 160, 162 may be exposed during conversion and/or transport. For example, rather than operating at 140 degrees Fahrenheit and applying a pressure of 1 psi to test specimens for 24 hours, lower temperatures (e.g., room temperature), higher pressures, and/or shorter dwell times may be employed.

The blocking resistance of some embodiments of the cold seal adhesives 160, 162 can be tested using specialized equipment, such as a Kohler Block Tester. Such a test can be conducted on test specimens or test samples in a manner resembling that set forth in ASTM D918. The test can include providing ten or more two-inch by two-inch samples of a body material 110 that has a cold seal adhesive 160, 162 disposed thereon. The samples are divided into sets of two, with the cold seal adhesive portions of the samples placed in contact with each other. Three-inch by two-inch foil sheets can be provided for use as interleaving sheets that are placed between adjacent sets of samples. The sets of samples are stacked on top of each other, with one sheet of foil between adjacent sample sets. The stacked samples are then placed on the bottom plate of a Kohler Block Tester. A centering plate of the Kohler Block Tester is placed over the samples, and then an appropriate spring is selected to provide the desired pressure to the samples. Examples of springs that may be used include those listed in the following table (Table 1), which identifies the serial number of the spring for use with a Kohler Block Tester and the loads each spring can provide:

TABLE 1

| Kohler Block Tester Spring Serial Number | Loading Capabilities | Loading Pressure Range |
|---|---|---|
| 1-361 | 1 lb.-15 lbs. | ~0.2 psi-~3.3 psi |
| 2-361 | 15 lbs.-50 lbs. | ~3.3 psi-~10.9 psi |
| 3-361 | 50 lbs.-200 lbs. | ~10.9 psi-~43.6 psi |
| 4-461 | 200 lbs.-2000 lbs. | ~43.6 psi-~436 psi |
| 1-377 | 1 lb.-15 lbs. | ~0.2 psi-~3.3 psi |
| 2-377 | 15 lbs.-50 lbs. | ~3.3 psi-~10.9 psi |
| 3-377 | 50 lbs.-200 lbs. | ~10.9 psi-~43.6 psi |
| 4-377 | 200 lbs.-2000 lbs. | ~43.6 psi-~436 psi |
| 1-215 | 1 lb.-15 lbs. | ~0.2 psi-~3.3 psi |
| 2-215 | 15 lbs.-50 lbs. | ~3.3 psi-~10.9 psi |
| 3-215 | 50 lbs.-200 lbs. | ~10.9 psi-~43.6 psi |
| 4-215 | 200 lbs.-2000 lbs. | ~43.6 psi-~436 psi |

With the desired spring in place and the centering plate in position, pressure is applied to the stack of samples by turning a pressure screw to the predetermined distance to achieve the desired pressure via the spring. The samples are left under the desired pressure conditions for the desired amount of time and under the desired environmental conditions. After the desired time has elapsed, the pressure is released from the sets of samples and the interleaving foil sheets are removed. Where an elevated temperature has been used for an environmental simulation, the sample sets can be allowed to cool. The samples are then separated from each other, and their resistance to blocking is evaluated. A rating or description of the blocking can be provided according to the following table (Table 2):

TABLE 2

| Rating | Blocking | Description |
|---|---|---|
| 0 | No blocking | No adhesion or cohesion between adjacent surfaces, which slide freely upon one another. Surfaces of specimens are not marred. |
| 1 | Cling | Slight adhesion between adjacent surfaces, but no distortion of surfaces or offset of coatings. |
| 2 | Slight blocking | Noticeable adhesion adjacent surfaces, which do not slide freely, but will with frictional pressure. Surface may show a very slight evidence of marring. Where applicable, ink transfer or coating pick may be observed. |
| 3 | Considerable blocking | Significant adhesion or cohesion of adjacent surfaces. Layers may be separated with difficulty. Surfaces will be marred or partially destroyed. Paper base materials will show loss of fiber. Synthetics may or may not display surface mar. |
| 4 | Complete blocking | Blocking to the extent of a complete seal or weld between adjacent surfaces which cannot be separated without destruction of the test specimen. |

A cold seal adhesive 160, 162 can be tested for dynamic loading conditions, such as may be experienced during or between stages of a converting process that precede a seam-forming stage (e.g., pinching that may occur as a web of body material 110 is fed through a converter). In one such test, the pressure is maintained for a dwell time of 1 second, the ambient temperature is maintained at 73 degrees Fahrenheit, and the relative humidity of the testing environment is maintained at 50%. Under these conditions, various embodiments of the cold seal adhesives 160, 162 can withstand loading pressures within a range of from about 100 psi to about 436 psi, of no more than about 100 psi, no more than about 150 psi, no more than about 200 psi, no more than about 250 psi, no more than about 300 psi, no more than about 350 psi, no more than about 400 psi, or no more than about 436 psi, no less than about 100 psi, no less than about 200 psi, no less than about 300 psi, or no less than about 400 psi with no more than "slight blocking" (i.e., with a blocking rating of 0, 1, or 2, as defined in Table 2). Certain of such embodiments can be advantageous, as it is believed that blocking either will not be encountered or will not pose significant difficulties during conversion of the bags under normal handling conditions prior to the desired sealing of such bags 100 using elevated temperatures.

A cold seal adhesive 160, 162 can be tested for static loading conditions, such as may be experienced during storage or transport of the body material 110 or the bags 100. For example, the cold seal adhesive 160, 162 may be applied to a web of the body material 110 that is subsequently rolled upon itself prior to its conversion of the into bags 100. As another example, a bag 100 may be only partially formed during the conversion, with one end thereof having a cold seal adhesive 160, 162 applied thereto but not yet sealed shut, and it thus can be desirable for this bag end to remain open until the bag 100 is filled with a desired product. In one test simulating storage and/or transport conditions, the pressure is maintained for a dwell time of 10 seconds, the ambient temperature is maintained at 130 degrees Fahrenheit, and the relative humidity of the testing environment is maintained at 50%. Under these conditions, various embodiments of the cold seal adhesives 160, 162 can withstand loading pressures within a range of from about 100 psi to about 436 psi, of no more than about 100 psi, no more than about 150 psi, no more than about 200 psi, no more than about 250 psi, no more than about 300 psi, no more than about 350 psi, no more than about 400 psi, or no more than about 436 psi, no less than about 100 psi, no less than about 200 psi, no less than about 300 psi, or no less than about 400 psi with no more than "slight blocking" (i.e., with a blocking rating of 0, 1, or 2, as defined in Table 2). Certain of such embodiments can be advantageous, as it is believed that blocking either will not be encountered or will not pose significant difficulties during conversion of the bags under normal handling conditions prior to the desired sealing of such bags 100 using elevated temperatures.

In some embodiments, the cold seal adhesives 160, 162 comprise the same composition (e.g., the adhesives are substantially the same), and in other embodiments, the cold seal adhesives 160, 162 have different compositions. For example, in some embodiments, the adhesive 160 may be harder than the cold seal adhesive 162.

With continued reference to FIG. 2, an adhesive 164 can be disposed along an edge of the right panel 130*b* at either an interior or an exterior surface thereof. In further embodiments, a corresponding adhesive (not shown) can be disposed along an edge of the left panel 130*a* at either an interior or exterior surface thereof. In some embodiments, the adhesive 164 (and/or its counterpart on the left panel 130*a*) can comprise a cold seal adhesive, and in further embodiments, the cold seal adhesive (and/or its counterpart on the left panel 130*a*) is the same as one or more of the cold seal adhesives 160, 162. In other embodiments, the adhesive 164 comprises a heat seal adhesive. The left and right panels 130*a*, 130*b* can be joined via the adhesive 164 to form the seam 152 (see FIG. 1).

With reference to FIGS. 1, 2, and 4, the lower seam 156 can be formed by folding the body material 110 along the dashed lines shown in FIG. 2, by placing section 162*a* in contact with sections 162*b* and 162*d*, section 162*c* in contact with section 162*d*, section 162*g* in contact with sections 162*f* and 162*d*, section 162*e* in contact with section 162*d*, and by applying pressure at the areas in which the aforementioned sections are in contact with each other. In some embodiments, the pressure is applied via heat seal jaws (not shown), which are known in the art. In various embodiments, the amount of pressure applied to form the seam 156 is within a range of from about 40 to about 80 psi, from about 50 psi to about 80 psi, or from about 60 psi to about 80 psi, or is no less than about 40 psi, no less than about 50 psi, no less than about 60 psi, or no less than about 70 psi. In other or further embodiments, any of the foregoing pressures are applied while heat is applied to the cold seal adhesive 160, 162 (e.g., via heat seal jaws) such that the cold seal adhesive is heated at a temperature within a range of from about 100 degrees Fahrenheit to about 250 degrees Fahrenheit, from about 150 degrees Fahrenheit to about 250 degrees Fahrenheit, or from about 200 degrees Fahrenheit to about 250 degrees Fahrenheit, or elevated temperatures of no less than about 100 degrees Fahrenheit, no less than about 125 degrees Fahrenheit, no less than about 150 degrees Fahrenheit, no less than about 175 degrees Fahrenheit, no less than about 200 degrees Fahrenheit, no less than about 225 degrees Fahrenheit, or no less than about 250 degrees Fahrenheit. The dwell time over which the pressure and/or heat are applied can be within a range of from about 0.25 seconds to about 2.5 seconds, from about 0.5 seconds to about 2.0 seconds, from about 1.0 seconds to about 2.0 seconds, no less than about 0.25 seconds, no less than about 0.5 seconds, no less than about 1.0 seconds, no more than about 0.5 seconds, no more than about 1.0 seconds, no more than about 1.5 seconds, or no more than about 2.0 seconds.

The resulting bond can be sufficiently strong to maintain the bag 100 in a closed orientation during the final stages of manufacture and subsequent transport. However, the bond can also be configured to weaken or release upon heating the bag 100 and/or the contents thereof. For example, heating the bag can raise the temperature of the adhesive 164, and steam from the contents of the bag 100 likewise can raise the temperature of the adhesive 164. Sufficient pressure from steam within the heated bag 100 can cause at least a portion of the adhesive 164 to separate from a wall of the bag 100 so as to permit venting of the steam. The bond can also be configured to permit relative easy opening of the bag 100 to allow access to its contents.

Figure 3:
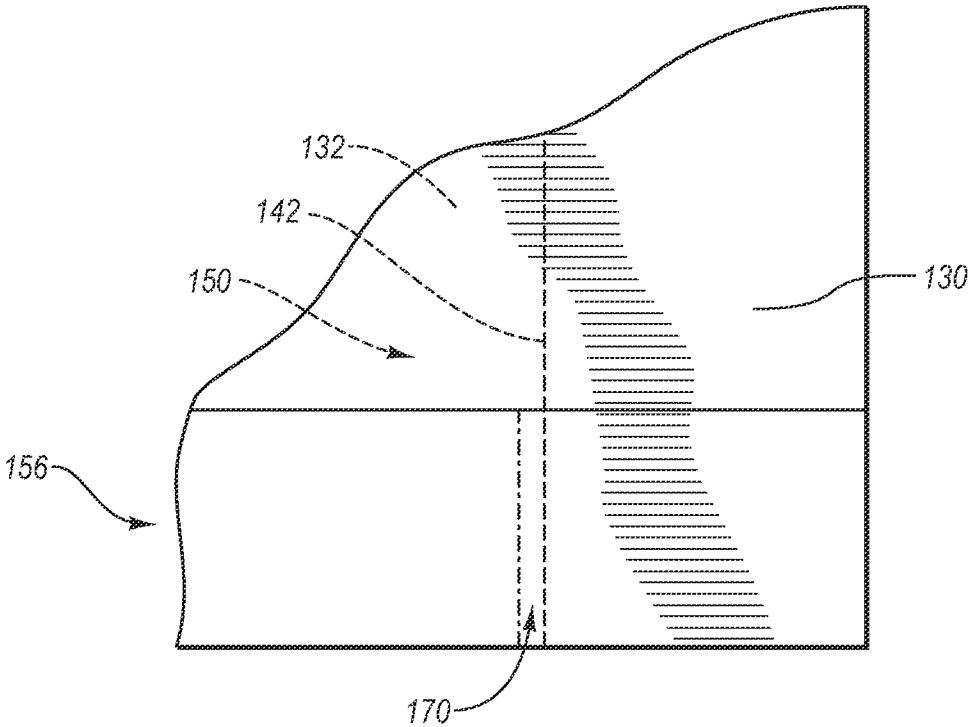
FIG. 3 is an enlarged plan view of a portion of the microwavable bag of FIG. 1 taken along the view line 3-3 in FIG. 1.

With reference to FIGS. 1, 3, and 4, in some embodiments, folding the body material 110 in a manner such as described above can cause the seam 156 to be thicker (as measured from the front wall 130 to the back wall 132) toward an edge of the bag 100 than it is at an intermediate position. The transition from the thicker region to the thinner region can be known as a step-down area.

The step-down area can include a gap or a channel 170, which can be at least partially defined by the crease 142 of the side wall 136 and by the front and back walls 130, 132. As shown in FIG. 3, the channel 170 can extend longitudinally between the interior cavity 150 and an exterior of the bag 100. As shown in FIG. 4, in certain embodiments, upon formation of the lower seam 156, the cold seal adhesive 162 fills or obstructs the channel 170 so as to prevent liquid oil from migrating from the interior cavity 150 to an exterior of the bag 100. As discussed above, in some embodiments, the cold seal adhesive 162 can be applied in relatively large amounts, which can help to ensure that sufficient adhesive 162 is available to fill and seal the channel 170. Similar channels can be formed and filled or obstructed at the left side and the upper end of the bag 100.

As mentioned above, previously known microwavable popcorn bags having a pinch-bottom closure are not suitable for retaining liquid oil. The Applicants have discovered that at least one reason for this unsuitability is that the channels 170 of these bags are not adequately obstructed. Rather, the channels 170 remain sufficiently open to permit liquid oil to pass through them.

With continued reference to FIG. 4, in some embodiments, an adhesive 175 at an exterior surface of the right sidewall 136 connects the front panel 136*a* to the back panel 136*b*. In some embodiments, the adhesive 175 comprises a cold seal adhesive, which may, in further embodiments, have the same composition as the cold seal adhesive 162. The front and back panels 134*a*, 134*b* of the left sidewall 134 can be similarly joined.

A food product can be introduced into the bag 100 prior to sealing the upper seam 154. In the embodiment illustrated in FIG. 5, the food product comprises a charge of unpopped popcorn kernels 180 and a fat component 185. As used herein, the term "fat component" is a broad term that can include, for example, fats, semi-solid fats, oils, and oil-containing slurries. For example, the term "fat component" can include oils that are in a liquid state at room temperature, as well as fats that have a melting point that is higher than room temperature and is either at, or lower than, the elevated temperatures commonly experienced during packaging and/or transport of microwavable popcorn bags. In various embodiments, the bag 100 can be compatible with (e.g., configured to maintain without leakage) fat components that are in a liquid state when at a temperature that is within a range of from about 60 degrees to about 79 degrees, from about 60 degrees to about 78 degrees, from about 60 degrees to about 77 degrees, from about 60 degrees to about 76 degrees, from about 60 degrees to about, 75 degrees, from about 60 degrees to about 74 degrees, from about 60 degrees to about 73 degrees, from about 60 degrees to about 72 degrees, from about 60 degrees to about 71 degrees, from about 60 degrees to about 70 degrees, from about 60 degrees to about 69 degrees, or from about 60 degrees to about 68 degrees Fahrenheit. In other or further embodiments, the bag 100 can be compatible with fat components that are in a non-solid state when at a temperature that is less than about 50 degrees, less than about 55 degrees, less than about 60 degrees, less than about 65 degrees, less than about 70 degrees, less than about 75 degrees, less than about 80 degrees, or less than about 85 degrees Fahrenheit.

After introduction of the food product into the bag 100, the upper seam 154 can be sealed. Referring again to FIG. 2, sealing the upper seam 154 can be accomplished by placing section 160*a* in contact with sections 160*b* and 160*d*, section 160*c* in contact with section 160*d*, section 160*g* in contact with sections 160*f* and 160*d*, section 160*e* in contact with section 160*d*, and applying pressure at the areas in which the aforementioned sections are in contact with each other. The discussion of amounts or weights of adhesives used, sealing pressures, sealing heat ranges, and sealing dwell times discussed above with respect to the lower seam 156 can apply to forming a seal at the upper seam 154. In some embodiments, one or more of these parameters are the same for both of the seams 154, 156. For example, as previously discussed, in some embodiments, the adhesives 160, 162 comprise the same substance.

In other embodiments, one or more of the amounts or weights of adhesives used, sealing pressures, and sealing dwell times discussed above with respect to the lower seam 156 may be different for each seam 154, 156. For example, in some embodiments, the bond strength for one of the seams 154, 156 is lower than it is for the other seam 154, 156, which may facilitate opening of the bag 100 to access the cooked contents of the bag 100. In some embodiments, one of the seams 154, 156 can include a crimp seal (not shown), while the other seam 154, 156 does not include a crimp seal. In certain of such embodiments, the seam 154, 156 that is not crimp sealed can be at the end of a bag 100 that is intended for opening by a consumer, whereas the crimp sealed seam 154, 156 does include a crimp seal such that the crimp sealed end of the bag 100 is more difficult to open. Creation of a crimp sealed seam can involve, for example, application of a different amount of pressure to the seam 154, 156.

As shown in FIG. 5, the bag 100 can include a susceptor 190 configured to interact with microwaves so as to generate heat. The susceptor 190 can be of any suitable variety, such as those known in the art or those yet to be devised. In some embodiments, the susceptor 190 comprises a flexible, metalized polyester sheet. In the illustrated embodiment, the susceptor 190 is positioned between the outer and inner paper plies 112, 114 within the back wall 132.

It will be understood by those having skill in the art that many changes may be made to the details of the above-described embodiments without departing from the underlying principles of the present invention. The scope of the present invention should, therefore, be determined only by the following claims. Recitation in the claims of the term "first" with respect to a feature or element does not necessarily imply the existence of a second or additional such feature or element.

What is claimed is:

1. A bag comprising:

a body material comprising a paper ply, the body material defining a tube having a first end and a second end, the tube comprising a front wall, a back wall, a first side wall joined to each of the front and back walls, and a second side wall joined to each of the front and back walls, wherein the front wall, the back wall, and the first and second side walls cooperate to define an interior cavity, wherein the first side wall includes a front panel and a back panel that meet at a first crease, and wherein the first crease is positioned between the front wall and the back wall such that a first channel is at least partially defined by the front wall, the back wall, and the first crease; and a seam that extends along an entirety of the first end of the tube, wherein the seam seals the first end of the tube to prevent liquid oil from exiting the interior of the cavity of the tube via the first end of the tube, wherein the seam is sealed along a full length thereof via only a first cold seal adhesive, and wherein the first cold seal adhesive obstructs the first channel sufficiently to prevent liquid oil from exiting the interior cavity of the tube via the first channel.

2. The bag of claim 1, further comprising a second cold seal adhesive extending along an entirety of the second end of the tube, wherein the second cold seal adhesive is in contact with each of the front wall, the back wall, and the two side walls, and wherein a seal formed by the second cold seal adhesive obstructs an additional channel at the second end of the tube sufficiently to prevent liquid oil from exiting the interior cavity of the tube via the second end of the tube.

3. The bag of claim 2, wherein the first and second cold seal adhesives have the same composition.

4. The bag of claim 1, wherein the second side wall includes a front panel and a back panel that meet at a second crease, wherein the second crease is positioned between the front wall and the back wall such that a second channel is at least partially defined by the front wall, the back wall, and the second crease, and wherein the first cold seal adhesive extends between the first channel and the second channel and obstructs the second channel.

5. The bag of claim 1, wherein the first cold seal adhesive is configured to seal the first end of the tube upon contact of separate portions of the first cold seal adhesive with each other and application of a pressure within a range of from about 40 psi to about 80 psi.

6. The bag of claim 5, wherein the first cold seal adhesive is configured to seal the first end of the tube when elevated in temperature during application of said pressure, and wherein the cold seal adhesive is heated at a temperature within a range of from about 100 degrees Fahrenheit to about 250 degrees Farenheit.

7. The bag of claim 1, wherein the body material further comprises a grease-resistant coating facing the interior cavity.

8. A microwavable popcorn bag comprising:

a body material comprising a paper ply, the body material defining a tube having a first end and a second end, the tube comprising a front wall, a back wall, a first side wall joined to each of the front and back walls, and a second side wall joined to each of the front and back walls, wherein the front wall, the back wall, and the first and second side walls cooperate to define an interior cavity, wherein the first side wall includes a front panel and a back panel that meet at a first crease, wherein the first crease is positioned between the front wall and the back wall such that a first channel is at least partially defined by the front wall, the back wall, and the first crease, wherein the second side wall includes a front panel and a back panel that meet at a second crease, and wherein the second crease is positioned between the front wall and the back wall such that a second channel is at least partially defined by the front wall, the back wall, and the second crease;

a charge of unpopped popcorn;

a fat component configured to be in a liquid state when at a temperature that is within a range of from about 60 degrees to about 79 degrees Fahrenheit; and a seam that extends along an entirety of the first end of the tube, wherein the seam seals the first end of the tube to prevent liquid oil from exiting the interior of the cavity of the tube via the first end of the tube, wherein the seam comprises a first cold seal adhesive that extends between the first crease and the second crease, and wherein the first cold seal adhesive obstructs the first and second channels sufficiently to prevent liquid oil from exiting the interior cavity of the tube via the first and second channels.

9. The bag of claim 8, wherein the first and second creases are positioned between the front wall and the back wall such that two additional channels are at least partially defined by the front wall, the back wall, and the first and second creases, respectively, the bag further comprising a second cold seal adhesive forming a seal at the second end of the tube that extends between the first and second creases, wherein the second cold seal adhesive obstructs the two additional channels such that the seal at the second end of the tube is configured to prevent liquid oil from exiting the interior cavity of the tube via the second end of the tube.

10. The bag of claim 9, wherein the first and second cold seal adhesives have the same composition.

11. The bag of claim 8, wherein the body material comprises a second paper ply laminated to the first paper ply.

12. The bag of claim 8, wherein the fat component is substantially free of trans fat.

13. A method of forming a bag, the method comprising:

providing a body material comprising a paper ply;

applying a cold seal adhesive to the body material continuously along a full edge of the body material;

forming a tube from the body material, the tube having a front wall, a back wall, a first side wall joined to each of the front and back walls, and a second side wall joined to each of the front and back walls;

folding the first side wall to form a crease; and pressing separate portions of the cold seal adhesive to each other at a first end of the tube so as to form a seal in which the crease is between the front and back walls and the cold seal adhesive obstructs a channel that is at least partially defined by the front wall, the back wall, and the crease sufficiently to prevent liquid oil from passing through the channel.

14. The method of claim 13, further comprising inserting a charge of unpopped popcorn and a fat component into the tube, wherein the fat component is configured to be in a non-solid state when at a temperature that is less than about 75 degrees Fahrenheit.

15. The method of claim 14, wherein the fat component is substantially free of trans fat.

16. The method of claim 14, further comprising sealing a second end of the tube via an additional quantity of the cold seal adhesive, wherein the second end of the tube remains sealed thereafter due only to the additional quantity of the cold seal adhesive.

17. The method of claim 13, wherein said pressing comprises applying a pressure within a range of from about 40 psi to about 80 psi.

18. The method of claim 17, wherein said pressing comprises applying pressure for a dwell time of no more than about 2 seconds.

19. The method of claim 17, further comprising heating the cold seal adhesive at a temperature of no less than about 100 degrees Fahrenheit to form said seal.

20. The method of claim 13, wherein the seal is formed of only the cold seal adhesive.

21. The bag of claim 1, further comprising an additional adhesive at an exterior surface of the first side wall that connects the front panel to the back panel, and wherein the additional adhesive is at the same longitudinal position as the seam.

22. The bag of claim 8, further comprising an additional adhesive at an exterior surface of the first side wall that connects the front panel to the back panel, and wherein the additional adhesive is at the same longitudinal position as the seam.

* * * * *